US007332463B2

(12) United States Patent
Greenberg

(10) Patent No.: US 7,332,463 B2
(45) Date of Patent: Feb. 19, 2008

(54) COLLOIDAL CLEANING SYSTEM COMPRISING A SAPONIFIED FATTY ACID AND AN ANIONIC/NONIONIC SURFACTANT MIXTURE

(75) Inventor: Robert Greenberg, Dana Point, CA (US)

(73) Assignee: On Legal Grounds, Inc., Dana Point, CA (US)

( * ) Notice: Subject to any disclaimer, the term of this patent is extended or adjusted under 35 U.S.C. 154(b) by 0 days.

(21) Appl. No.: 11/386,158

(22) Filed: Mar. 21, 2006

(65) Prior Publication Data

US 2006/0247146 A1 Nov. 2, 2006

Related U.S. Application Data

(60) Provisional application No. 60/673,855, filed on Apr. 22, 2005.

(51) Int. Cl.
*C11D 10/04* (2006.01)
*C11D 1/83* (2006.01)

(52) U.S. Cl. ..... 510/240; 510/426; 510/427; 510/430; 510/432; 510/437; 510/450; 510/454; 510/481; 510/488; 510/491

(58) Field of Classification Search ..... 510/240, 510/426, 427, 430, 432, 437, 450, 454, 481, 510/488, 491
See application file for complete search history.

(56) References Cited

U.S. PATENT DOCUMENTS

| | | | | |
|---|---|---|---|---|
| 5,786,312 | A * | 7/1998 | Post et al. | 510/152 |
| 6,472,364 | B1 | 10/2002 | Heltovics | |
| 6,838,420 | B2 * | 1/2005 | Sachdev | 510/141 |
| 2002/0169093 | A1 | 11/2002 | Muller et al. | |

FOREIGN PATENT DOCUMENTS

WO WO 03/089563 A2 10/2003

OTHER PUBLICATIONS

PCT Search Report mailed on Jul. 17, 2006 for PCT Application No. PCT/US2006/010714.

* cited by examiner

*Primary Examiner*—Charles Boyer
(74) *Attorney, Agent, or Firm*—Knobbe, Martens, Olson & Bear, LLP

(57) ABSTRACT

Cleaning formulations, methods, and systems are effective, mild, and non-hazardous. Embodiments of the cleaning formulation comprise a fatty acid, a saponifier, a water conditioner, a solvent, a nonionic surfactant, and an anionic surfactant. Some embodiments also optionally additives. Embodiments are particularly effective for cleaning concrete.

15 Claims, No Drawings

COLLOIDAL CLEANING SYSTEM COMPRISING A SAPONIFIED FATTY ACID AND AN ANIONIC/NONIONIC SURFACTANT MIXTURE

CROSS-REFERENCE TO RELATED APPLICATIONS

This application claims the benefit of U.S. Application No. 60/673,855, filed on Apr. 22, 2005, the disclosure of which is incorporated by reference in its entirety.

BACKGROUND OF THE INVENTION

1. Field of the Invention

This application is generally related to cleaning formulations, and more particularly, to a colloidal cleaning formulation, method, and system for concrete and other washable surfaces.

2. Description of the Related Art

Many of the cleansers, soaps, detergents, and cleaning chemicals available for the public are acidic in nature, most are also damaging to the environment and/or harmful to humans.

SUMMARY OF THE INVENTION

Cleaning formulations, methods, and systems are effective, mild, and non-hazardous. Embodiments of the cleaning formulation comprise a fatty acid, a saponifier, a water conditioner, a solvent, a nonionic surfactant, and an anionic surfactant. Some embodiments also optionally comprise one or more additives. Embodiments are particularly effective for cleaning concrete.

Some embodiments provide a cleaning formulation comprising: about 25% to about 50% of a fatty acid; about 15% to about 25% of a saponifiers; about 4% to about 16% of a water conditioner; about 12% to about 24% of a solvent; about 8% to about 32% of a nonionic surfactant; and about 1% to about 6% of an anionic surfactant. In some embodiments, the formulation comprises: about 30% to about 40% of a fatty acid; about 17% to about 20% of a saponifiers; about 6% to about 10% of a water conditioner; and about 16% to about 20% of a solvent; about 14% to about 20% of a nonionic surfactant; and about 2% to about 4% of an anionic surfactant. In some embodiments, the fatty acid comprises a tall oil fatty acid. In some preferred embodiments, the tall oil fatty acid comprises a high tall oil rosins content. In some embodiments, the saponifier comprises 2-amino-2-methyl-1-propanol. In some embodiments, the water conditioner comprises a cationic cellulose polymer. In some preferred embodiments, the cationic cellulose polymer comprises a cellulosic backbone grafted with polyquaternium-4 side chains. In some embodiments, the nonionic surfactant comprises an octylphenol ethoxylate. the anionic surfactant comprises an alkylnaphthalene sulfonate. Some embodiments, further comprising water. Some embodiments further comprise one or more materials selected from the group consisting of lanolin, coconut oil, and fragrance.

Also provided is a method for cleaning an article comprising contacting at least a portion of the article with a formulation of comprising: about 25% to about 50% of a fatty acid; about 15% to about 25% of a saponifiers; about 4% to about 16% of a water conditioner; about 12% to about 24% of a solvent; about 8% to about 32% of a nonionic surfactant; and about 1% to about 6% of an anionic surfactant. In some embodiments, the cleaning formulation is diluted with water. Some embodiments further comprise mechanically scrubbing at least a potion of the article. In some embodiments, the article comprise a concrete surface.

Also provided is a system for cleaning an article comprising: a cleaning formulation comprising about 25% to about 50% of a fatty acid; about 15% to about 25% of a saponifiers; about 4% to about 16% of a water conditioner; about 12% to about 24% of a solvent; about 8% to about 32% of a nonionic surfactant; and about 1% to about 6% of an anionic surfactant; and instructions for contacting at least a portion of the article with the cleaning formulation. Some embodiments further comprise a means for applying the cleaning formulation to at least a portion of the article. Some embodiments further comprise a means for mechanically cleaning at least a portion of the article.

Also provided is a cleaning formulation comprising: about 36% fatty acid; about 18% 2-amino-2-methyl-1-propanol; about 8% cationic cellulose polymer; about 18% methyl soyate; about 16% octylphenol ethylate; and about 3% of alkylnaphthalene sulfonate.

Also provided is a use of a formulation for cleaning at least a portion of an article, wherein the formulation comprises: about 25% to about 50% of a fatty acid; about 15% to about 25% of a saponifiers; about 4% to about 16% of a water conditioner; about 12% to about 24% of a solvent; about 8% to about 32% of a nonionic surfactant; and about 1% to about 6% of an anionic surfactant.

DETAILED DESCRIPTION OF THE PREFERRED EMBODIMENTS

This application relates to cleaning formulations, and methods and systems using the formulations. Embodiments of the disclosed formulation are particularly effective in removing oils and/or soils under mild conditions, and consequently, are useful for numerous cleaning applications. Preferred embodiments of the formulation exhibit enhanced wetting properties, which provide improved cleaning of small pores, crevices, and/or spaces. Some embodiments are particularly useful for cleaning compounds comprising long carbon chains, for example, petroleum and/or biologically derived oils. Some embodiments are useful for cleaning body fluids, for example, blood, urine, lymph, pus, and the like, which comprise, for example, fats, carbohydrates, proteins, and other components known in the art. Embodiments of the cleaning formulation are useful for cleaning concrete, both in residential and commercial settings. Embodiments are useful in cleaning natural stone, marble, granite, soapstone, synthetic stone, ceramic, tile, and/or terrazzo. As discussed in greater detail below, preferred embodiments of the cleaning formulation are alkaline, and consequently, do not etch or dissolve concrete and/or cement. In using an embodiment of the formulation to clean metals and fluorescent fixtures, an accidental spill onto oil contaminated soil also demonstrated that the formulation dissolved the oil therefrom, and consequently, was found to be useful in soil remediation and the like. Some embodiments are one or more of the following: a hand cleaner, laundry cleaning enhancer, fabric cleaner, carpet cleaner and/or spot cleaner, odor remover, jewelry cleaner (including cleaning pearls and/or opals), grease cleaner, oven cleaner, tile cleaner, grout cleaner, scum remover, lime remover, automobile wheel cleaner, engine degreaser, recreational vehicle wash, fiberglass boat cleaner, industrial floor cleaner and wax stripper, degreaser, auto repair and parts cleaner, car wash, boat/ship cleaner, bilge cleaner, diesel cleaner, oil leak/spill clean up, fire retardant, soil remediation agent, mold remediation agent, anti-acne skin cleanser and/or treatment, earwax remover/emulsifier, antibacterial, and/or insecticide.

Embodiments of the cleaning formulation comprise a fatty acid, a saponifier, a water conditioner, a solvent, and one or more surfactants. Some embodiments also optionally comprise another solvent and/or additives, for example, an emollient such as lanolin and/or coconut oil (coconut butter). Some embodiments comprise a fragrance. Proportions of these components in some preferred embodiments are provided in TABLE I. Lanolin and/or coconut oil comprise from 0 to about 4% of the formulation by weight in some embodiments. Embodiments of the formulation have a pH of from about 9 to about 13, including from about 10 to about 11. Preferred embodiments of the formulation do not comprise a soap and/or detergent. Embodiments of the formulation are particularly active in solubilizing, emulsifying, and/or dispersing organic soils and materials.

TABLE I

| Component | Range (wt %) | Preferred Range (wt %) |
|---|---|---|
| Fatty acid | about 25% to about 50% | about 30% to about 40% |
| Saponifier | about 15% to about 25% | about 17% to about 20% |
| Water Conditioner | about 4% to about 16% | about 6% to about 10% |
| Solvent | about 12% to about 24% | about 16% to about 20% |
| Nonionic Surfactant | about 8% to about 32% | about 14% to about 20% |
| Anionic Surfactant | about 1% to about 6% | about 2% to about 4% |

The term "colloid" is used herein with its usual meaning, as well as to refer to submicroscopic particles that are electrically charged and repel each other in a ceaseless random movement. Typically, colloids are separable on the basis of density by the use of an ultracentrifuge.

Examples of suitable fatty acids are known in the art, including fatty acids from any suitable source, for example, vegetable derived, animal derived, tall oil fatty acids, tall oil rosin acids, tall oil rosin, and the like. In some embodiments, the fatty acids have from about 10 to about 30 carbon atoms, preferably, from about 12 to about 20 carbon atoms, and include saturated, monounsaturated, and/or polyunsaturated fatty acids. Unsaturated fatty acids have cis- and/or trans-double bonds. Some embodiments comprise fatty acids with triple bonds. Preferred fatty acids are tall oil fatty acids, which optionally contain tall oil rosin and/or tall oil rosin acids, and are commercially available as Sylvatal® and Sylfat® from Arizona Chemical (Jacksonville, Fla.). Tall oil typically comprises mainly palmitic acid, oleic acid, and linoleic acid. Tall oil rosins are present in from about 0% to about 35%. A suitable tall oil fatty acid is commercially available from Arizona Chemical (Jacksonville, Fla.) as Sylvatal® D30LR, which comprises tall oil fatty acid with a high tall oil rosins content. Mixtures are also suitable. Some embodiments of suitable fatty acids substantially do not coagulate when mixed with a saponifiers discussed below.

Suitable saponifiers are known in the art. Preferred saponifiers include amino alcohols, for example, 2-amino-1-butanol (AB®, Dow Chemical, Midland, Mich.), 2-amino-2-methyl-1,3-propanediol (AMPD™, Dow Chemical, Midland, Mich.), 2-amino-2-methyl-1-propanol (AMP™, AMP™-95, Dow Chemical, Midland, Mich.), 2-amino-2-ethyl-1,3-propanediol (AEPD®, Dow Chemical, Midland, Mich.), tris(hydroxymethyl)aminomethane (TRIS AMINO®, Dow Chemical, Midland, Mich.), ethanolamines, and combinations thereof. In some preferred embodiments, the saponifier is 2-amino-2-methyl-1-propanol (AMP™-95).

Suitable surfactants include non-ionic, anionic, and/or cationic surfactants known in the art. Suitable non-ionic surfactants include polyethoxylates, polyether alcohols, branched secondary alcohol ethoxylates (Tergitol® TMN series, Dow Chemical, Midland, Mich.), ethylene oxide/propylene oxide copolymers (Tergitol® L Series, Tergitol® XD, XH, and XJ, Dow Chemical, Midland, Mich.), nonylphenol ethoxylates (Tergitol® NP Series, Dow Chemical, Midland, Mich.), octylphenol ethoxylates (Triton® X Series, Dow Chemical, Midland, Mich.), secondary alcohol ethoxylates (Tergitol® 15-S Series, Dow Chemical, Midland, Mich.), glycol esters, triglyceride ethoxylates, alkanolamides, sorbitan ester ethoxylates, linear and branched alcohol alkoxylates, fatty alcohol ethoxylates, block copolymer products, and combinations thereof. In some preferred embodiments, the nonionic surfactant comprises an octylphenol ethoxylate (Triton® X).

Suitable anionic surfactants include organic carboxylates, sulfosuccinates, sulfonates, sulfates, and/or phosphonates. Preferred embodiments include alkylnaphthalene sulfonates (e.g., Petro®, Akzo Nobel, Chicago, Ill.), alkylbenzene sulfonates, and α-olefin sulfonates. Some preferred embodiments do not comprise phosphorus compounds. In some preferred embodiments, the anionic surfactant comprises an alkylnaphthylene sulfonate (Petro®)

Suitable cationic surfactants include organic ammonium and pyridinium compounds, including fatty amines, quaternary amines, and/or ester amines. In some embodiments, the fatty amines are primary, secondary, tertiary, and/or diamines. In some preferred embodiments, the fatty amines are from $C_8$ to about $C_{22}$. Preferred embodiments of the quaternary amine are quaternarized versions of the disclosed fatty amines.

Suitable solvents are known in the art, for example, aqueous solvents, alcoholic solvents, organic solvents, and combinations thereof. Preferred solvents include organic solvents. In some preferred embodiments, the solvent is a natural organic solvent, for example, transesterified vegetable oils. Some preferred embodiments use alkyl soyate solvents, which are produced by the transesterification of soy bean oil. Preferred solvents include methyl and/or ethyl soyates. Methyl soyate is commercially available, for example, as DESOL™ (DESOL Inc., San Diego, Calif.).

Suitable water conditioners include cationic polymers known in the art. Examples include polyquaternium compounds, cationic cellulosic polymers, cationic guars, cationic starch polymers, cationic graft and/or block copolymers, combinations, and the like. Suitable polyquaternium compounds are poly(diallyldimethylammonium) compounds, including polyquaternium-4, polyquaternium-7, polyquaternium-10, and/or higher polyquaternium compounds. Suitable cationic cellulose polymers include compounds comprising a cellulosic backbone, for example, cellulose, hydroxyethylcellulose, hydroxypropylcellulose, hydroxyethylmethylcellulose, hydroxypropylmethylcellulose, and the like, to which polyquaternium side chains are grafted (Celquat®, National Starch, Bridgewater, N.J.). Suitable cationic guars include guar hydroxypropyltrimonium compounds (AquaCat®, Hercules, Wilmington, Del.). In some preferred embodiments, the water conditioner comprises a cationic cellulose polymer. It is believed that the water conditioner acts as a tracking agent as well as a sequestrant.

Some embodiments comprise one or more independently selected additives known in the art, for example, fragrances, emollients, lanolin, coconut oil, dyes, pigments, defoamers, viscosity modifiers, preservatives, abrasives, and the like. In some embodiments, the components of the formulation are selected such that substantial coagulation or precipitation does not occur on mixing and/or standing.

In use, the formulation is contacted with the article to be cleaned. Embodiments of the formulation are typically diluted with water or another solvent before use, although some embodiments are also used neat, for example, in particularly difficult cleaning applications. The degree of dilution depends on the particular application. In some embodiments, the dilution is from about 1:1 to about 30:1, preferably, about 5:1 to about 20:1. All reported dilutions are by volume, with the volume of formulation as the second value. Unless otherwise specified, the diluent is water. In some preferred embodiments, the formulation is diluted with warm and/or hot water, although cold and/or cool water is also useful in other embodiments, for example, in cleaning delicate surfaces and/or articles that are heat sensitive. In some embodiments, the formulation is diluted immediately prior to application using means known in the art, for example, using an applicator with a mixing head and/or a hose-end mixer. In some embodiments, the formulation is sprayed on under pressure, for example using a spray applicator and/or a pressure washer known in the art. In some embodiments, the formulation is fogged to treat a space or volume. In some embodiments, at least a portion of the article to be cleaned is immersed in the formulation, typically diluted with water. Spot or local treatment is used in some applications, for example, laundry and carpet cleaning. It is believed that the formulation's cleaning properties arise from a combination of wetting, dissolution, dispersion, and/or emulsification.

In some preferred embodiments, the article is also mechanically cleaned while in contact with the cleaning formulation using methods known in the art, for example, using brushes, brooms, cleaning pads, abrasives, combinations thereof, and the like. The particular method will depend on factors known in the art, for example, the characteristics of the article to be cleaned, the amount of soil or contaminant to be removed, and the like. Those skilled in the art will understand that mechanical cleaning serves to physically remove contaminant(s) on a surface, as well as to replace the cleaning formulation at or near the surface, which is laden with the contaminant(s) with fresh cleaning formulation. In some embodiments, the mechanical action also helps to disperse the contaminant(s) in the cleaning formulation. The mechanical cleaning is manual and/or automated. In some embodiments, a mechanical cleaning device is also configured to apply the cleaning formulation to the article to be cleaned. In other embodiments, ultrasonic energy is used to assist the cleaning.

Embodiments of the formulation are usable under a range of temperature conditions, from the freezing point to the boiling point. Preferred embodiments of the formulation are not photoactive.

After the article or surface is cleaned, it is typically rinsed to remove residual contaminants and/or cleaning formulation. Optionally, the article is dried by means known in the art, for example, by blowing a gas, for example, air, by vacuuming, by heating, by freeze drying, by contacting with a sorbant, squeegeeing, combinations thereof, and the like.

The undiluted formulation is also useful as a lubricant. Because it is non-toxic, it is especially suited to the lubrication of medical devices, surgical devices, food processing machinery, and other devices or machinery where non-toxic materials are preferred.

EXAMPLE 1

A preferred embodiment of the formulation is provided below in TABLE II and referred to herein as "Like New." The components were mixed in a 1000 gal (3,785 L) tank.

TABLE II

| Component | Source | Manufacturer | wt % |
|---|---|---|---|
| Fatty acid | Sylvatal ® D30LR | Arizona Chemical | 36.36% |
| Saponifier | AMP ®-95 | Dow Chemical | 18.00% |
| Water Conditioner | Celquat ® H-100 | National Starch | 8.08% |
| Solvent | DESOL | DESOL Inc. | 18.00% |
| Nonionic Surfactant | Triton ® X-45 | Union Carbide | 8.08% |
| Nonionic Surfactant | Triton ® X-114 | Union Carbide | 8.08% |
| Anionic Surfactant | Petro ® 22 | Akzo Nobel | 3.40% |

Celquat® H-100 has a cellulosic backbone (hydroxyethylcellulose) with polyquaternium-4 side chains grafted in a comb-like structure. Triton® X-45 is an octylphenol ethoxylate, where the ethoxylate unit comprises an average of about 4.5 ethoxylate units. Triton® X-114 is an octylphenol ethoxylate, where the ethoxylate unit comprises an average of about 7.5 ethoxylate units. Petro® 22 is a proprietary mixture of sodium alkylnaphthalene sulfonate and a nonionic surfactant.

The Like New formulation is alkaline, nontoxic, biodegradable within seven days, and has colloidal characteristics. The formulation comprises with seven separate chemicals, some of which have a pH of 12.5 or more. The formulation of TABLE II has a pH of about 10.5 before dilution.

EXAMPLE 2

The formulation of EXAMPLE 1 (Like New) was diluted 5:1 using water and a fluid reservoir mounted on a rotary scrubber machine filled with the cleaning mixture. The machine had a 1.5 hp motor and was equipped with 17"-(43-cm) high-abrasive-polycarbonate brush (pad). The concrete surface had oil and tire stains. The cleaning formulation was applied to the concrete surface and the surface scrubbed until it was substantially free of stains. The surface was rinsed with clean water, then squeegeed to remove excess water. The surface was vacuumed with a wet/dry vacuum, then allowed to dry. It is believed that the vacuuming removes residual formulation from the pores of the concrete, which can prevent adhesion of sealants, paints, etc. A liquid polymer sealant was then sprayed onto the cleaned surface.

EXAMPLE 3

EXAMPLE 1 was repeated up to the scrubbing step, which formed a stiff foam. The foam was broken-down by spraying with water. The polycarbonate brush was replaced with a softer nylon brush and the concrete surface scrubbed again. The surface was rinsed, squeegeed, vacuumed and sealed as described above. It is believed that the added water improves the penetration of the formulation into the concrete pores, and that the brushing flushes the pores, thereby providing improved cleaning. In some cases, the sealed surface was oversprayed with a concrete layer.

EXAMPLE 4

Physical analysis of the formulation of EXAMPLE 1 (Like New) provided the following results:

| Property | Result |
|---|---|
| Appearance | Homogenous Blend |
| Insoluble Matter | 0.04% |
| Color | Light copper-amber |
| Vapor Pressure (20° C.) | 17.0 mm |
| pH | 10.77 |
| Vapor Density (Air = 1) | 0.62 (Prior to dilution) |
| Odor | Mild to Pleasant (unscented) |
| Water Solubility | 99.935% |
| Viscosity | 110 cps |
| Specific Gravity (wt/gal) | 8.6 lb |
| Flash Point | None |
| Percent volatile by volume | None |
| Boiling Point | 212° F. (100° C.) |
| Surface Tension (dynes/cm, 25° C.) | 29.5 |
| Toxicity | None |
| Evaporation Rate (butyl acetate = 1) | 0.7 |
| Arsenic | None |
| Nitrate | None |
| Borate | None |
| NTA | None |
| Boron | None |
| Petroleum Solvent | None |
| Caustic | None |
| Phenol | None |
| Chlorine | None |
| Phosphates ($PO_4$) | None |
| Cresol | None |
| Silicates | None |
| Enzymes | None |
| a. Proteolytic | None |
| b. Lipolytic | None |
| c. Amoylolytic | None |
| Sulfates ($SO_4$) | None |
| Halogen | None |

EXAMPLE 5

Hard Water Stability

Preparation of hard water stock solution: A 20 grain hard water stock solution was prepared by dissolving 0.40±0.005 g of calcium acetate dihydrate ($Ca(C_2H_3O_2)_2.2H_2O$, analytical), and 0.28±0.005 g of analytical reagent magnesium sulfate heptahydrate ($MgSO_4.7H_2O$, analytical) in 1 L of boiled, distilled water.

Procedure: To three clean 50-mL graduated cylinders was added 5 mL of a 25% V/V aqueous solution of Like New. To each graduate was added 45 mL of the hard water stock solution. Each resulting solutions was mixed well and allowed to stand for 24 hours at 25±5° C. (77±0° F.), after which each was examined for precipitation. Each solution was agitated by five inversions of the graduates, and their turbidities measured using an Orbeco-Hellige turbidimeter using the test for silica. Test results were averaged.

| Test 1 | Test 2 |
|---|---|
| <10 ppm | <10 ppm |

EXAMPLE 6

Cold Stability

About 50 mL of Like-New was poured into a test tube and cooled to −18±5° C. (0±9° F.) for about 1 hour. The compound was then allowed to return to room temperature. After 5 inversions of the test tube, the formulation was examined for homogeneity.

| Test 1 | Test 2 |
|---|---|
| Returned to normal appearance | Returned to normal appearance |

EXAMPLE 7

Analysis for Phosphate

A standard phosphate test was performed as follows. A 10.000 g sample of the formula of EXAMPLE 1 was weighed in a porcelain or a silica evaporating dish. The sample was ignited gently over a low gas flame until most of the combustible matter was burned off, then transferred to a muffle furnace at not more than 550° C. for 10-15 minutes. The resulting residue was not necessary free of carbon. The residue was cooled, then 10 mL of concentrated HCl was added, and the mixture transferred to 400-mL beaker. The volume of the solution was brought to about 100 mL using water, and contains an excess of at least 10 mL concentrated HCl. The beaker was covered with a watch glass and boiled for 30-60 minutes in the presence of phosphates of the glassy type. The solution was cooled to room temperature, dilutes to 200 mL with water, and adjusted to pH 4.3, first using 50 percent NaOH, then using 0.5 and/or 0.01 N NaOH. In some cases, the resulting solution was cooled to maintain temperature below 30° C. The solution was titrated with a NaOH solution to a pH 8.8 end point. The percent total of phosphorus as $P_2O_5$ is (T×N×7.098)/(Weight of Sample), where N is the normality of the NaOH solution used in the titration, and T is the volume of NaOH solution used in the titration.

EXAMPLE 8

Heat Stability

A 50 mL sample of the formulation of EXAMPLE 1 (Like New) was placed in a 50-mL graduated cylinder, which was then stoppered. The graduate was placed in a 60±2° C. (140±3° F.) water bath for 6 hours. At least 30 mL of the formulation was submerged.

| Test 1 | Test 2 |
|---|---|
| No separation or layering | No separation or layering |

EXAMPLE 8

Emulsibility

A 10 mL sample of a 25% (V/V) aqueous mixture of the formulation of EXAMPLE 1 was placed in a 50-mL glass stoppered, graduated cylinder. A 30 mL sample of a cleaning solvent (Mil-P-D-680 type 2) was added. An emulsion was formed by ten inversions of the graduate followed by a vigorous 15 second shake. After allowing the emulsion to stand for 5 minutes, the sample was again agitated 15 seconds. The resulting emulsion was allowed to stand for 6 hours. At the end of the 6 hour period the emulsion was examined for layering of oil and water.

| | Test 1 | Test 2 | Test 3 |
|---|---|---|---|
| Water | 1.00 mL | 0.8 mL | 0.90 mL |
| Oil | No free oil | No free oil | No free oil |

EXAMPLE 9

Flammability

A sample of the formulation of EXAMPLE 1 (Like New) was placed in an open cup and brought to boil. A flame was applied to the boiling liquid.

| Test 1 | Test 2 |
|---|---|
| No flash | No flash |

EXAMPLE 10

Biodegradability

The biodegradability of the formulation of EXAMPLE 1 (Like New) was evaluated using a standard test method (Journal of the Water Pollution Control Federation) using a standard solution of sodium dodecylsulfate (SDS) as a control. The concentrations of both samples were 20 ppm in B.O.D. dilution water containing yeast extract and inoculated with sewage. The flasks were subcultured for 3 one-week periods to assure that the organisms were acclimated to the compounds.

Degradation of SDS was determined by the usual methylene blue test. Degradation of Like New was determined as described in the Journal of Water Pollution and Control.

Percent Degraded in 7 Days

| SDS | Formulation of Example 1 |
|---|---|
| 99.0% | 99.0% |

EXAMPLE 11

Surface Tension

The surface tension of Like New was measured at 29.5 dynes/cm at 25° C. A 1/1625 ratio of Like New/tap water had a surface tension of 36 dynes/cm at 25° C., which was determined by plotting the surface tensions of serially diluted solutions of Like New.

EXAMPLE 12

Fresh or Ocean Water Performance

Fresh and ocean water performance was evaluated using standard U.S. Federal test methods.

Procedure No. 1. A 10 mL sample of the formulation of EXAMPLE 1 (Like New) was mixed with 10 mL unprocessed crude oil with a specific gravity of 23±0.5 in a 200-mL round bottomed flask, and the mixture vigorously shook for 10 seconds. A 150 mL sample of ocean water was placed in a first 200-mL graduated cylinder, a 150 mL sample of fresh tap water was placed in a second 200-mL graduated cylinder, and 5 mL of the Like New and crude oil mixture was added to each graduate, which were then stoppered. The contents of each graduate were mixed by inverting five times, and the graduates allowed to stand for one hour at room temperature. The surfaces of the graduates were visually examined for free crude oil. Any available floating particles of crude oil were spread evenly on a 1×2 glass slide using glass stirring rod, which was then rinsed with fresh tap or ocean water for one minute. All traces of oil should dissipate in the water. The formulation passed the test.

Procedure No. 2. One 4"×6" sheet each of aluminum alloy (2024, Fed. Spec. QQ-A-250/4) and magnesium alloy (AZ318 or higher, Fed. Spec. QQ-M-44) were thoroughly cleaned with trichloroethylene (technical, Fed. Spec. O-T-634) and weighed. One side of each sheet was uniformly coated with a mixture of 40 weight machine oil and carbon black, which provided improved visibility, and weighed to determine the amount of oil on each sheet. Each sheet was laid on a level surface with the oiled side up and sprayed with a mixture of 1 part Like New diluted with 7 parts tap water until thoroughly wet. After a dwell time of 5 minutes, each sheet was immersed in a gently agitated rinse tank of fresh tap water for 5 minutes, then oven dried at 150° F. for 10 minutes. The sheets were reweighed to determine the amount of oil removed, which is expressed as a percentage. Substantially all of the oil was removed.

EXAMPLE 13

Toxicity

No environmental toxicity was observed.

Oral Toxicity. Eighteen male Long-Evans rats with an average body weight of 268 g (range 256-280 g) were divided into three comparable groups of 6 animals each. To group 1 was administered by stomach tube a single dose of Like New at 1 mL per 100 g body weight. To group 2 was administered by stomach tube a single dose of Like New at 0.5 mL per 100 g body weight. To group 3, which served as a control group, was administered by stomach tube a single dose of 1 mL of physiologic saline solution at 1 mL per 100 g body weight. Rats were placed in individual cages with raised screen bottoms and were provided food (Purina Laboratory Chow) and water ad libitum. Animals were kept under observation for 14 days after which they were weighed and autopsied. The average weight increment of rats in the various groups after 14 days feeding was as follows:

| | |
|---|---|
| Group 1 | 44.4 g |
| Group 2 | 48.6 g |
| Group 3 | 47.2 g |

Differences in weight increment between the various groups were not statistically significant. No gross deleterious or noxious effects were observed in any of the rats administered with Like New. There were no significant differences in the appearance of the internal organs between the test and control animals.

Cutaneous Toxicity. Twelve male New Zealand White rabbits were selected with an average body weight of 2291 g (range 2134-2416 g), and were divided into two comparable groups of 6 animals each. An area of about 2"×3" in size was shaved on the mid-dorsal lateral region of each animal. In one of the groups, the skin in the shaved area was left intact; in the other it was abraded by making a series of shallow cuts with a sharp instrument. Rabbits were placed in individual metal cages and were provided with food and water ad libitum over the course of the experiment. Like New was then swabbed to the shaved area of both groups daily for a total of 4 days. The animals were observed at 10 minute intervals during the first hour after application, and twice daily thereafter. The animals were kept under observation for one week after the initial application. No gross deleterious effects were observed in any of the rabbits. All gained weight (an average of 177 g) over the course of the experiment and appeared normal in all respects.

EXAMPLE 14

Stress Crazing of Acrylic-Based Plastics

Three specimens of sheet acrylic plastic (MIL-P-5425) were annealed by suspending in an oven at 90±2° C. (194±4° F.) for 2 hours. At the end of the annealing period the temperature of the specimens was reduced to room temperature at a rate of 27±5° C. (49±9° F.) per hour maximum. The annealed specimens were then conditioned at room temperature for 7 days before use. Each three specimens was set up as a cantilever beam and carefully stressed to 3,000 pounds per square inch outer fiber stress. After 10 minutes the specimens were examined to ensure no crazing had occurred. While the specimens were still under stress, an absorbent swatch of cotton approximately ¾ inch square was placed on the tension side of the specimen, directly over the fulcrum. Like New was carefully applied to the cotton swatch and the swatch was kept wet by additional applications as necessary. After 24 hours and while the specimens were still under stress, the cotton swatch was removed and the specimens rinsed with tap water and reexamined for crazing, cracking, or other effects.

| Test 1 | Test 2 |
|---|---|
| No cracking or crazing | No cracking or crazing |

EXAMPLE 15

Challenge Study with *E. Coli*

A 5:1 dilution of the formulation of EXAMPLE 1 (Like New) in water (V/V) was tested in triplicate and evaluated on Day 0, Day 1, and Day 3. Tested concurrently with the product were three quality control samples (Blank Product, Positive Control, Negative Control). The challenge organism (*E. coli* ATCC 25922) was cultured and transferred to the 3 product samples (triplicate) and the Positive Control at a final concentration of about $1.0\times10^6$. The challenge organism was not added to the Blank Product or the Negative Control. Representative portions were aseptically removed from each test container and inoculated in duplicate onto Petrifilm for enumeration by AOAC 99114. These first samples are identified as Day 0 and represent the concentration prior to incubation. The study was conducted at ambient temperature and additional portions were aseptically removed after 24 hrs (Day 1) and 72 hrs (Day 3). The test organism, *E. coli*, was allowed to grow for 48 hours on Petrifilm before counting colonies and evaluating the data.

The data indicated that no growth of the challenge organism, *E. coli*, occurred in the presence of the Like New 5:1 solution. Triplicate samples of the product tested on Day 0, Day 1, and Day 3 exhibited no growth while the Positive Control showed a slow but significant increase. The growth of *E. coli* in the Positive Control and absence of growth in the Blank and Negative Control validated the test. Additional observations indicate the *E. coli* challenge organism was not viable after one hour exposure to a 5:1 solution of Like New.

Other commercially available cleaning products, for example, CLR® (Jelmar, Skokie, Ill.), Simple Green® (Sunshine Makers, Inc., Huntington Harbour, Calif.), and Oxi-Clean® (Orange Glo International, Littleton, Colo.), accomplish some of the tasks but do not cover the myriad uses of the preferred embodiments of the disclosed formulation. For example, preferred embodiments are useful for cleaning and/or degreasing most washable surfaces. Examples include combinations of concrete, asphalt, tar foundation materials, natural stone, marble, granite, terrazzo, poultry, eggs, railroad rails and ties, sewers, leather, ovens, stoves, tile, grout, carpeting, fabrics, fabric stains, laundry, soil, interior and exterior aircraft components, painted surfaces (may soften latex paint), animal enclosures, plastic, Plexiglas®, fiberglass, metals, and the like. Some preferred embodiments are also useful in clean and stripping wax from vehicles, cars, boats, and floors. Some embodiments are useful for cleaning storage tanks for crude oil and/or refined petroleum products. Some embodiments emulsify or strip mastic of the type used to lay flooring and/or tile, for example, linoleum, vinyl flooring, and the like. Some embodiments clean rust and/or corroded metal surfaces.

As discussed above, in some preferred embodiments, the formulation is diluted, for example, with water, prior to use. As used herein, the term "formulation" also refers to diluted embodiments. The dilutions are provided merely as guidelines. Those skilled in the art will understand that some applications use more or less concentrated solutions, and that such solutions are also within the scope of this disclosure.

Some cleaning applications use the formulation in combination with other cleaning products known in the art. For example, embodiments of the formulation are useful as a laundry detergent with chlorine and/or oxygen bleach. Other additives known in the art are also useful in laundry applications, for example, water softeners, soaps, detergents, deodorants, and the like. In other embodiments, embodiments of the formulation are used alone as a laundry detergent, and are effective in removing stains, soils, body oils, odors, and the like.

Some embodiments kill bacteria, both airborne and on surfaces. Some embodiments appear to treat acne, including adult acne. It is believed that the anti-bacterial effect combined with the removal of oil is at least in part responsible for this activity. Some embodiments kill mold and/or mildew, spores thereof, and/or prevent spore germination. It has been found that treatment using Like New kills up to about 50% of viable mold spores within 10 seconds of contact and 99% within 30 minutes, with no mold regrowth after 60 days. Some embodiments of these applications use a dilution of about 5-10:1. In some embodiments, the affected area is fogged with the diluted formulation, for example, in air ducts, and with stud cavities in walls. In other embodiments, the affected surface is sprayed and/or saturated with the diluted formulation.

Moreover, embodiments of the disclosed formulation safely clean the skin, for example, removing excess oils from the skin and pores, for example, at a dilution of about 5-15:1. Embodiments containing optional emollients, for example, lanolin and/or coconut oil, are particularly useful for cleaning skin because of the moisturizing effect of these additives. Some embodiments break down ear wax, for example, diluted to about 10-15:1. Embodiments are also useful in treating scabies, lice, fleas, ticks, and the like by washing the skin, for example, at a dilution of about 8-9:1, or the hair at a dilution of about 10-12:1. This treatment is useful in humans and other animals, for example, dogs and cats. Embodiments of the formulation are also pesticidally effective against insects, other arthropods, and the like in household, commercial, and/or agricultural applications on animals, plants, and/or surfaces. In some embodiments, the treated article or surface is a soft material, for example, fabrics, mattresses, upholstery, and the like. Examples include ants, silverfish, aphids, bedbugs, lice, scabies, ticks, fleas, and the like.

Some embodiments are also safe to livestock, pets, marine life, aquatic life, and the like. Accordingly, no protective clothing is necessary in some applications. Some embodiments are useful in soil remediation and/or decontaminating bodies of fresh water, for example, lakes, ponds, and/or streams. In these embodiments, runoff of the cleaning formulation into waterways is also safe. Similarly, disposal of these embodiments raises substantially no safety problems.

Some embodiments neutralize odors, for example, pet, smoke, and human waste odors, for example, diluted at about 5-12:1. A dilution of about 5:1 is effective in removing skunk odors.

Some embodiments are useful for air stream cleaning (air cleaning). In some embodiments, the formulation is diluted about 10-20:1 with water and the solution fogged into the air stream. In some embodiments, the fog is removed downstream using a filter or other trap. The fogging method is also useful for cleaning air ducts, ventilation ducts, HVAC systems, and the like. Some embodiments effectively neutralize acid and/or acidic gases. Some embodiments effectively suppress fires and prevent reignition.

Preferred embodiments not comprise ingredients listed as hazardous in the state of California under Proposition 65 as of the filing date of this application, or under the State of California Safe Drinking and Water Act of 1986.

Table III provides exemplary dilutions of the formulation of EXAMPLE 1 (Like New) in water for a variety of applications.

TABLE III

| Application | Preferred Dilution of About |
|---|---|
| Laundry | 10-16:1 |
| Carpet | 8-9:1 |
| Pet odors | 5-12:1 |
| Mold | 5-10:1 |
| Garages or driveways | 5-8:1 |
| Tarnish | 10:1 |
| Automobile wheels | 5-6:1 |
| Automobile engine degreasing | 5-6:1 |
| Household cleaning | 10-12:1 |
| Ovens | 5:1 |
| Recreational vehicles/boats | 8-10:1 |
| Jewelry | 8:1 |

TABLE III-continued

| Application | Preferred Dilution of About |
|---|---|
| Floors or concrete | 5-10:1 |
| Removing mastic | 5:1 |
| Hand cleaner | 5-15:1 |
| Removing earwax | 10-15:1 |
| Antibacterial | 5-10:1 |
| Oil field clean up | 5-8:1 |

While certain embodiments have been described, these embodiments have been presented by way of example only, and are not intended to limit the scope of the disclosure. Those skilled in the art will understand that the formulations, methods, and systems described herein may be embodied in a variety of other forms. Furthermore, various omissions, substitutions and changes in the form of the formulations, methods, and systems described herein may be made without departing from the spirit of this disclosure. The accompanying claims and their equivalents are intended to cover such forms or modifications.

What is claimed is:

1. A cleaning formulation comprising:
about 25% to about 50% of a fatty acid;
about 15% to about 25% of a saponifiers;
about 4% to about 16% of a water conditioner;
about 12% to about 24% of a solvent;
about 8% to about 32% of a nonionic surfactant; and
about 1% to about 6% of an anionic surfactant different than the saponified fatty acid;
wherein the saponifier comprises 2-amino-2-methyl-1-propanol.

2. A cleaning formulation comprising:
about 25% to about 50% of a fatty acid;
about 15% to about 25% of a saponifiers;
about 4% to about 16% of a water conditioner;
about 12% to about 24% of a solvent;
about 8% to about 32% of a nonionic surfactant; and
about 1% to about 6% of an anionic surfactant different than the saponified fatty acid;
wherein the water conditioner comprises a cationic cellulose polymer.

3. The formulation of claim 2, wherein the cationic cellulose polymer comprises a cellulosic backbone grafted with polyquatemium-4 side chains.

4. A cleaning formulation comprising:
about 25% to about 50% of a fatty acid;
about 15% to about 25% of a saponifiers;
about 4% to about 16% of a water conditioner different than the saponifiers;
about 12% to about 24% of a solvent;
about 8% to about 32% of a nonionic surfactant; and
about 1% to about 6% of an anionic surfactant different than the saponified fatty acid;
wherein the nonionic surfactant comprises an octylphenol ethoxylate.

5. A cleaning formulation comprising:
about 25% to about 50% of a fatty acid;
about 15% to about 25% of a saponifiers;
about 4% to about 16% of a water conditioner different than the saponifiers;
about 12% to about 24% of a solvent;
about 8% to about 32% of a nonionic surfactant; and
about 1% to about 6% of an anionic surfactant;
wherein the anionic surfactant comprises an alkylnaphthalene sulfonate.

6. A cleaning formulation comprising:

about 36% fatty acid;

about 18% 2-amino-2-methyl-1-propanol;

about 8% cationic cellulose polymer;

about 18% methyl soyate;

about 16% octylphenol ethoxylate; and about 3% of alkylnaphthalene sulfonate.

7. The formulation of claim 6, further comprising water.

8. The formulation of claim 6, further comprising one or more materials selected from the group consisting of lanolin, coconut oil, and fragrance.

9. A method for cleaning an article comprising contacting at least a portion of the article with the formulation of claim 6.

10. The method of claim 9, wherein the cleaning formulation is diluted with water.

11. The method of claim 9, further comprising mechanically scrubbing at least a potion of the article.

12. The method of claim 9, wherein the article comprises a concrete surface.

13. A system for cleaning an article comprising:

the cleaning formulation of claim 6; and instructions for contacting at least a portion of the article with the cleaning formulation.

14. The system of claim 13, further comprising a means for applying the cleaning formulation to at least a portion of the article.

15. The system of claim 13, further comprising a means for mechanically cleaning at least a portion of the article.

* * * * *